US006726382B2

(12) United States Patent
Buttner et al.

(10) Patent No.: US 6,726,382 B2
(45) Date of Patent: Apr. 27, 2004

(54) BUNDLE FOR PROCESSING CHEMICALS

(75) Inventors: Peter Buttner, Rösrath (DE); Marc Reiners, Hürth (DE)

(73) Assignee: AGFA-Gevaert (BG)

( * ) Notice: Subject to any disclaimer, the term of this patent is extended or adjusted under 35 U.S.C. 154(b) by 0 days.

(21) Appl. No.: 10/322,190

(22) Filed: Dec. 18, 2002

(65) Prior Publication Data

US 2003/0123875 A1 Jul. 3, 2003

(30) Foreign Application Priority Data

Dec. 20, 2001 (DE) ..... 101 62 748

(51) Int. Cl.[7] ..... G03D 3/02
(52) U.S. Cl. ..... 396/626; 396/578; 430/419
(58) Field of Search ..... 396/578, 626; 355/27–29, 77; 430/418, 419; 137/565.33, 571; 222/39

(56) References Cited

U.S. PATENT DOCUMENTS

| | | | | |
|---|---|---|---|---|
| 4,098,431 | A | 7/1978 | Palmer et al. | 222/39 |
| 5,178,994 | A | 1/1993 | Yamada | 430/419 |
| 6,193,424 | B1 | 2/2001 | Ogiso | 396/578 |

*Primary Examiner*—D. Rutledge
(74) *Attorney, Agent, or Firm*—Connolly Bove Lodge & Hutz LLP

(57) ABSTRACT

A bundle for photographic processing chemicals containing the concentrates for all the processing steps for processing a photographic material, wherein the concentrations of chemicals in the individual concentrates are selected such that all the concentrates are prepared with the same quantity of water in each case and the resultant replenishing liquids for all the processing steps are sufficient for the same quantity of photographic material, makes it possible largely to avoid operating errors and provides simple monitoring of the replenishment rate of the individual baths.

9 Claims, No Drawings

BUNDLE FOR PROCESSING CHEMICALS

When colour negative film is processed to produce a finished paper print, the photographic materials pass through a series of processing baths which must contain the correct concentrations of the correct chemicals, for example:

film development bath
film bleach bath
film fixing bath
film stabilising bath
paper development bath
paper bleach/fixing bath
paper stabilising bath.

These are thus processing baths for colour negative film or for colour negative paper.

When the phrase colour photographic material is used below, it denotes both film and paper.

These materials are increasingly processed in small, decentralised processing units or minilabs ("one hour processing service"), which are often operated by staff who have received little training. It is thus necessary to arrange the working procedure in such a manner that operating errors can largely be avoided.

With regard to the processing chemicals, this equipment is used in the following manner:

The equipment has a processing tank for each process step, through which tank the photographic material is passed for processing, and a replenisher tank, from which the processing tank is supplied in accordance with material throughput. The processing tank should always contain approximately the same volume of processing liquid, wherein the processing chemicals are, as far as possible, always present at the same concentration in the processing liquid.

The replenishing liquid in the replenisher tank decreases in accordance with the replenishment rate, i.e. in accordance with the quantity which flows from the replenisher tank into the processing tank in accordance with material throughput. Once the liquid in the replenisher tank falls below a certain level, for example 10%, the operating personnel are alerted, for example by illumination of a red lamp, that the replenisher tank must be filled up.

This is achieved by adding to the replenisher tank one or more chemical concentrates for each processing liquid and a predetermined quantity of water for the particular replenishing liquid.

For chemical and technical reasons, the replenishment rates are different for the individual processing baths. Given a fixed and uniform replenisher volume for the individual processing baths, this results in different yields for the replenishing liquids and thus in different time intervals at which the replenishing liquids for the individual processing baths must be prepared and also in different quantities of water which are required for preparing the replenishing liquid.

This procedure readily results in operating errors and moreover has the disadvantage that uniform inventory management is not possible.

The object of the invention was to modify the parameters of the process in such a manner that the disadvantages may largely be avoided.

This is achieved with a processing chemical bundle which contains the concentrates for all the processing steps for processing a photographic material, wherein the concentrations of chemicals in the individual concentrates are selected such that all the concentrates are prepared with the same quantity of water in each case and the resultant replenishing liquids for all the processing steps are sufficient for the same quantity of photographic material. The replenisher volume of the individual processing baths may here be different.

The bundle may contain one or more concentrates, preferably one or two concentrates, for each individual process step. This is necessary for chemical and technical reasons if the chemicals required for one processing bath cannot be stored in a single concentrate without decomposing or if a replenisher for one processing bath has a considerably greater volume than the other replenishers for the remaining processing baths.

The bundle preferably consists of a packaging unit comprising exactly the concentrates necessary for processing a specific quantity of a photographic material.

The bundle according to the invention provides the operator of a "minilab" with the advantage that all the replenishers for the processing baths can be prepared with the same quantity of water. Further advantages are that the operator need no longer order the various concentrates individually once they have been used up, but instead need only order the desired quantity of the bundles according to the invention.

Another advantage is that all the replenishing liquids should be used up and require refilling at about the same time. If a replenisher is used up substantially earlier or later than the other replenishers, the operator will be able to assume that there is some kind of problem with the replenishment rate (for example failure of the replenishing pump) and be able to take appropriate action.

The invention is illustrated by means of the following Examples.

EXAMPLES

Example 1

Prior Art

Colour paper is processed in a minilab using the process steps colour development (CD), 33 s, 38° C.
bleach/fixing (BX), 33 s, 36° C.
stabilisation (SB), 4×19 s, 36° C.
drying.

The processing tanks are replenished as follows from the replenishing tanks:

CD with a replenishing rate of 90 ml/m$^2$ of colour paper, wherein 10 L of replenishing fluid have a yield of 111 m$^2$, prepared from three concentrates with 8.5 L of water.

| | | |
|---|---|---|
| CD concentrate | part A: | 0.5 L |
| | part B: | 0.5 L |
| | part C: | 0.5 L |
| | water: | 8.5 L |
| produces 10 L of CD replenisher. | | |

BX with a replenishment rate of 110 ml/m$^2$ of colour paper, wherein 10 L of replenishing fluid have a yield of 91

$m^2$ and are prepared from two concentrates with 7 L of water.

| | | |
|---|---|---|
| BX concentrate | part A: | 2 L |
| BX concentrate | part B: | 1 L |
| | water: | 7 L |
| produces 10 L of BX replenisher. | | |

SB with a replenishing rate of 200 ml/$m^2$ of colour paper, wherein 20 L have a yield of 100 $m^2$ and are prepared from one concentrate with 19.75 L of water.

| | |
|---|---|
| SB concentrate | 0.25 L |
| water | 19.75 L |
| produces 20 L of SB replenisher. | |

Different quantities of water must accordingly be measured out for preparing the replenishing liquids, with preparation taking place at different times.

Example 2

Invention

Process steps and replenishment rates are the same as in Example 1.

The concentrates are all prepared with 8 L of water.

The concentrates are bundled in a packaging unit which contains a CD concentrate in a quantity of 1 L, a BX concentrate in a quantity of 3 L and two SB concentrates of identical composition each in a quantity of 2 L, wherein each of the SB concentrates is prepared with 8 L of water.

The greater replenishment rate and thus the larger volume of the SB replenishing bath is required because the intention is to ensure not only stabilisation but also adequate rinsing.

The concentrates have a yield of 100 $m^2$ for all processing baths, wherein SB must be prepared twice as frequently as CD and BX.

| | |
|---|---|
| CD concentrate | 1 L |
| Water | 8 L |
| produces 9 L of CD replenisher. | |
| BX concentrate | 3 L |
| Water | 8 L |
| produces 11 L of BX replenisher. | |
| SB concentrate | 2 L |
| Water | 8 L |
| produces 10 L of SB replenisher. | |

What is claimed is:

1. A bundle for photographic processing chemicals containing the concentrates for all the processing steps for processing a photographic material, wherein the concentrations of chemicals in the individual concentrate are selected such that all the concentrates are prepared with the same quantity of water in each case and the resultant replenishing liquids for all the processing steps are sufficient for the same quantity of photographic material.

2. A bundle according to claim 1, characterised in that the photographic material is a colour negative film.

3. A bundle according to claim 1, characterised in that the photographic material is a colour paper.

4. The bundle according to claims 1, wherein the bundle contains the concentrates for a film development bath, a film bleach bath, a film fixing bath and a film stabilizing bath.

5. The bundle according to claim 2, wherein the bundle contains the concentrates for a film development bath, a film bleach bath, a film fixing bath and a film stabilizing bath.

6. A bundle according to claim 1, wherein the bundle contains the concentrates for a paper development bath, a paper bleach/fixing bath and a paper stabilizing bath.

7. A bundle according claim 5, wherein the bundle contains the concentrates for a paper development bath, a paper bleach/fixing bath and a paper stabilizing bath.

8. A bundle according to claim 1, wherein the bundle contains one or two concentrates for each processing bath.

9. A bundle according to claim 7, wherein the bundle contains one or two concentrates for each processing bath.

* * * * *